United States Patent [19]

Porat

[11] 3,932,718

[45] Jan. 13, 1976

[54] INTRUSION DETECTOR

[76] Inventor: Chaim Porat, Mivtza Chorev 21, Beersheba, Israel

[22] Filed: July 1, 1974

[21] Appl. No.: 485,045

[52] U.S. Cl. ..... 200/61.93; 200/161; 335/205

[51] Int. Cl.[2] ..... H01H 3/02; H01H 36/00

[58] Field of Search..... 200/61.41, 61.93, 161, 200/79, 153 K; 335/205; 340/256, 276, 274, 421

[56] References Cited

UNITED STATES PATENTS

| | | | |
|---|---|---|---|
| 2,342,034 | 2/1944 | Beakes | 340/241 X |
| 2,607,866 | 8/1952 | Fruh | 200/61.93 |
| 2,897,307 | 7/1959 | Johnston | 200/61.93 X |
| 2,907,014 | 9/1959 | Hollingsworth | 200/61.93 X |
| 3,243,797 | 3/1966 | Smith | 200/79 X |
| 3,402,269 | 9/1968 | Gregory | 335/205 X |
| 3,450,852 | 6/1969 | Rhodes | 200/61.93 |
| 3,596,021 | 7/1971 | Saul | 200/61.93 |
| 3,634,638 | 1/1972 | Saryon et al. | 200/61.93 |
| 3,696,380 | 10/1972 | Murphy | 200/61.93 X |

*Primary Examiner*—James R. Scott

*Attorney, Agent, or Firm*—Benjamin J. Barish

[57] ABSTRACT

An intrusion detector comprises a housing attachable to a fixed support, an electrical switch fixed within the housing and having a switch actuator movable within a longitudinal bore in the housing to actuate the switch. The actuator is attachable to a wire tensioned between it and another fixed support so as to actuate the switch upon stretching or cutting the wire, a spring being disposed within the housing bore and having one end engaging the movable actuator to bias it in the direction opposite to the tensioned wire. A closure member closes one end of the bore and engages the opposite end of the spring and is adjustable to preset the initial non-actuating position of the actuator with respect to the switch.

9 Claims, 4 Drawing Figures

INTRUSION DETECTOR

BACKGROUND OF THE INVENTION

The present invention relates to intrusion detectors such as are used for protecting a specific confined area against intrusion by unauthorised persons.

A number of intrusion detection devices are known. One type includes an electrical switch which is attached to a wire fence enclosing the area to be protected, such that when the wire is pulled apart or cut in order to gain entry into the protected area, the change in tensioning of the wire actuates the electrical switch to provide a signal or alarm. One of the problems in such an intrusion detector device is to prevent false alarms arising from the wire being tensioned by temperature changes or the wind, so that the intrusion detector is responsive only to actual pulling or cutting the wire.

A number of techniques have been proposed for solving the above problem. One technique, as illustrated in U.S. Pat. No. 3,634,638, includes a switch construction which distinguishes between quick movements on the one hand as caused by pulling or cutting the wire, and slow movements on the other hand as caused by temperature changes or the wind. Another proposed arrangement, as illustrated in U.S. Pat. No. 3,243,797, senses the rate of change of the wire tension to determine whether the change is due to intrusion or to temperature, and if the change is gradual because of a temperature change, then a motor rebalancing system is actuated to compensate for the gradual temperature change.

One object of the present invention is to provide a new and improved intrusion detector device for use with a tensioned wire, which device can be conveniently preset for a specific operating point.

An additional object of the present invention is to provide an intrusion detector device having improved means for discriminating between a tensioning of the wire caused by an intrusion, and a tensioning of the wire caused by temperature or wind changes, so that the detector is actuated only upon the occurrence of the former and not upon the occurrence of the latter. Another object is to provide an improved intrusion detector based on the use of a magnetic reed switch.

According to the present invention, there is provided an intrusion detector comprising a housing attachable to a fixed support and an electrical switch fixed within the housing. The housing is formed with a longitudinal bore extending at least partly therethrough, the switch actuator being movable within the longitudinal bore to actuate the switch. The actuator is attachable to a wire tensioned between it and another fixed support so as to actuate the switch upon stretching or cutting the wire. Disposed within the bore is a spring having one end engaging the movable actuator to bias same in the direction opposite to the tensioned wire. An adjustable closure member closes one end of the bore and engages the opposite end of the spring to preset the initial non-actuating position of the actuator with respect to the switch.

In one described embodiment, the tensioned wire is a stretchable wire tensioned between two fixed supports, the movable switch actuator being attached to the tensioned wire at an intermediate point thereof such that the stretchability of the span of wire between one of the wire supports and the movable switch actuator is substantially equal to that of the span of wire between the other wire support and the movable actuator, whereby the switch is actuated only upon the differential tensioning of the two wire spans such as caused by pulling or cutting the wire and not upon the equal and opposite tensioning of the two wire spans such as caused by temperature changes or the wind.

In another described embodiment, the tensioned wire includes only one span, one end of the wire being connected to the fixed wire support and the opposite end of the wire being connected to the movable switch actuator.

Preferably, the electrical switch is a reed switch, the switch actuator including a permanent magnet for actuating the switch when moved a predetermined amount.

The preferred embodiment of the invention described below, which includes the differential tensioning means, thus provides a very simple and effective arrangement for discriminating between the tensioning of the wire caused by an intrusion, and a tensioning of the wire caused by temperature or wind changes, and actuates the detector only upon the occurrence of the former and not upon the occurrence of the latter.

However, features of the invention can advantageously be used even without the differential tensioning arrangement, as will be apparent from the second embodiment of the invention described below.

BRIEF DESCRIPTION OF THE DRAWINGS

The invention is herein described, by way of example only, with reference to the accompanying drawings, wherein.

DETAILED DESCRIPTION OF THE ILLUSTRATED EMBODIMENT

Figure 1:
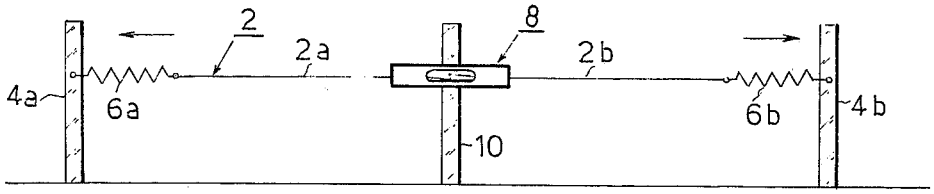
FIG. 1 illustrates an intrusion detector arrangement constructed in accordance with the present invention particularly for large spans and including the differential-tensioning feature for preventing or minimizing false alarms.
Figure 2:
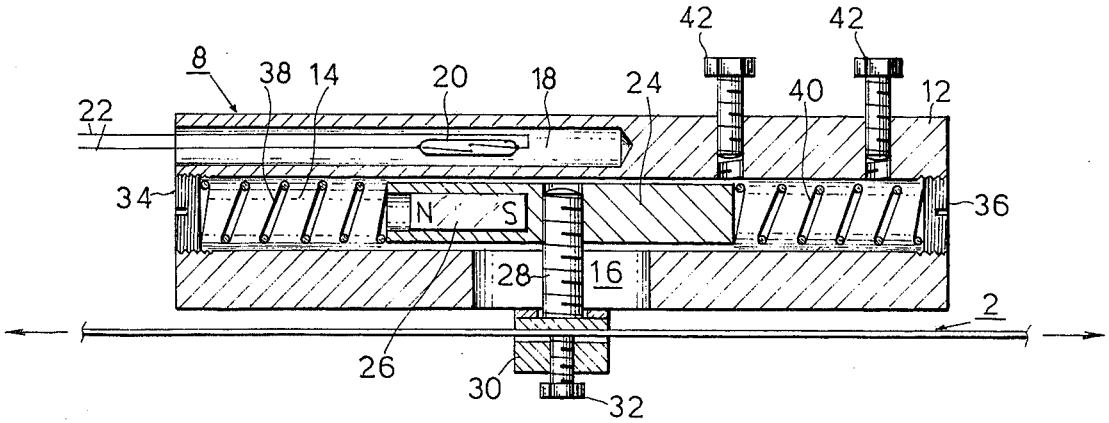
FIG. 2 is an enlarged sectional view illustrating the detector of FIG. 1.

The preferred embodiment of the invention is illustrated in FIGS. 1 and 2. This embodiment includes a stretchable wire, generally designated 2, tensioned between two fixed wire supports 4*a*, 4*b*. The device further includes a pair of balanced (i.e. substantially of equal strength) springs 6*a*, 6*b*, each being connected between one end of the wire and its fixed wire support.

The intrusion detector, generally designated 8, is fixed to a further support 10 intermediate the two wire supports 4*a*, 4*b*, and is attached to the tensioned wire 2 between the latter two supports. Thus, two spans of the tensioned wire 2 are formed, one span 2*a* being attached between detector 8 and one wire support 4*a*, and the other span 2*b* being attached between detector 8 and the other wire support 4*b*.

Detector 8, as best shown in FIG. 2, includes a housing 12 of non-magnetic material formed with a central longitudinal bore 14, and with a slot 16 communicating with the bore. A blind bore 18 is formed laterally of bore 14, and disposed within blind bore 18 is a reed switch 20 having conductors 22 for attachment to an electrical device, such as an indicator, signal or alarm. If desired, blind bore 18 may be filled with a plastic potting material for fixing reed switch 20 therein and also for protecting the reed switch against shock, vibration, and moisture.

The actuator for reed switch 20 is a cylindrical, non-magnetic member 24 disposed within bore 14 of the housing, and carrying at one end a permanent magnet 26 aligned with the reed switch. Actuator 24 further includes an arm 28 extending through slot 16 of the housing. The end of arm 28 carries a clamp 30 having a threaded bolt 32 for attachment to the tensioned wire 2 (FIG. 1).

Bore 14 is closed at both ends by closure members 34, 36. Interposed between the closure members and actuator 24 are a pair of balanced springs 38, 40, spring 38 being between one end of actuator 24 and its respective closure member 34, and the other spring 40 being between the other end of actuator 24 and the other closure member 36. Preferably one, or both, of the closure members 34, 36 are threaded into the respective end of bore 14 so as to be able to preset the initial position of permanent magnet 26 of the switch actuator 24 with respect to reed switch 20, and also to preset the magnitude of force required to actuate the switch.

The intrusion detector 8 is mounted to its fixed support 10 (FIG. 1) by means of a pair of clamps 42 carried by housing 12.

The intrusion detector illustrated in FIGS. 1 and 2 is used in the following manner:

First, the switch actuator 24 is preset so that its permanent magnet 26 is exactly aligned with reed switch 20, with the arm 28 of the actuator passing through the middle of slot 16. This presetting may be done by adjsting one or both of the end closure members 34, 36. In the described example, the contacts of reed switch 20 are biassed apart but are closed by the magnet 26 when aligned with them, so that the reed switch 20 would normally be closed when the switch actuator 24 has been preset in the position illustrated.

Next, the detector 8 is mounted to its fixed support 10 by means of clamps 42, and then clamp 30 of the switch actuator is closed by means of bolt 42 onto the wire 2 tensioned between the two fixed wire supports 4*a*, 4*b*. The device is now in condition for detecting intrusions involving pulling or cutting either of the wire spans 2*a* or 2*b*.

For example, if wire span 2*b* is pulled, this will cause the switch actuator 24, by virtue of its attachment to the wire by clamp 30, to be moved in the direction of the pulling force (rightwardly, in FIG. 1). This movement of switch actuator 24 causes its permanent magnet 26 to move with respect to the fixed reed switch 20, and when the permanent magnet has moved a predetermined distance, the reed switch will open, thereby transmitting a signal via its conductors 22. On the other hand, if span 2*b* of the wire is cut, switch actuator 24 will be moved by the tension of wire span 2*a* in the opposite direction (leftwardly in FIG. 1), and when the permanent magnet 26 carried by the actuator moves a predetermined distance, it will likewise cause reed switch 20 to open, thereby signalling this condition.

The device thus detects any change in the tension of wire 2 arising because of an attempted entry into the area protected by the device, and actuates reed switch 20 in response thereto. This switch can be connected to a signal, indicator, or alarm to indicate this condition and/or to actuate another device, e.g. an explosive.

On the other hand, the detector device will not respond to changes in tension of wire 2 arising because of temperature changes or the wind. This is because temperature changes or the wind will produce a substantially equal change in tension in both wire spans 2*a*, 2*b*, and since these are equal and opposite, switch actuator 24 will not be moved, at least not sufficiently to actuate the reed switch 20. This very simple arrangement thus effectively minimizes the possibility of false alarms.

The device cannot only discriminate between wire-tension variations caused by attempted entry, from those caused by temperature-changes or the wind, but can also discriminate between wire-pulling attempted entry from a wire-cutting attempted entry. Thus, if the wire is pulled to gain entry, causing the switch actuator 24 to be moved until it actuates reed switch 20, as soon as the pulling is terminated switch actuator 24 will return to its normal, non-actuating condition. On the other hand, if the wire is cut causing the switch actuator 24 to be moved by the tension of the non-cut wire span to actuate switch 20, the switch actuator does not return, and therefore the switch will remain in its actuated condition. Thus, by monitoring whether the reed switch remains in its actuated condition or returns to its normal condition, it can be determined whether the unauthorized intrusion involved pulling or cutting the wire.

After the detector system illustrated in FIGS. 1 and 2 has been installed for a period of time, ground settling or the like may cause a slight inequality in the tension applied by the two spans 2*a*, 2*b* to the switch actuator 24. This can be easily corrected by merely loosening clamp 30 of the actuator to permit the wire to move in order to even the tension, and then reclamping it to the wire.

It will be appreciated that the balanced springs 6*a*, 6*b* are not essential where the wire itself is stretchable, for example plastic wire, particularly where long spans of the wire are used.

Figure 3:
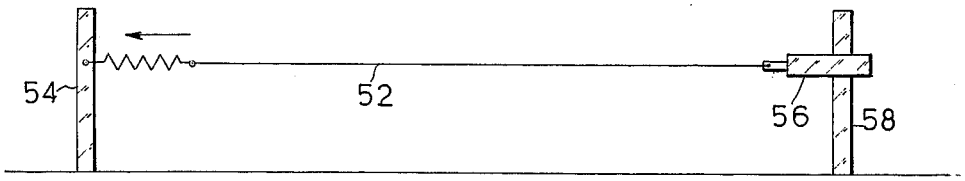
FIG. 3 illustrates another embodiment of the invention particularly for smaller spans wherein the intrusion detector does not include the differential-tensioning feature.
Figure 4:
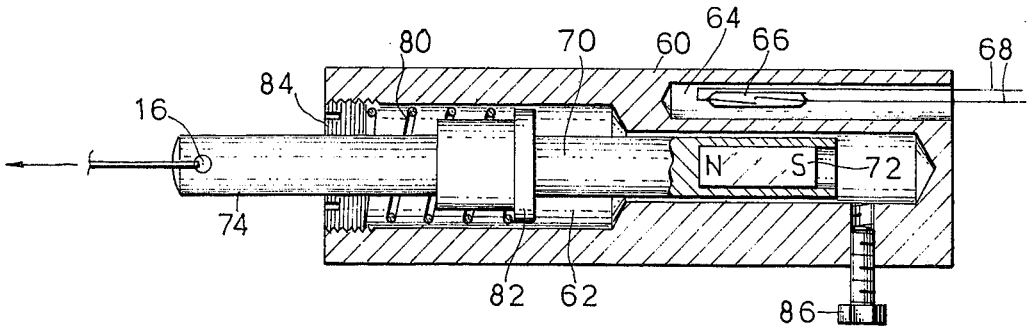
FIG. 4 is an enlarged sectional view illustrating the detector of FIG. 3.

FIGS. 3 and 4 illustrate a further embodiment of the invention not involving the differential tensioning feature for discriminating between temperature-producing and wind-producing changes in tension, from intrusion-producing changes in tension. In the embodiment of FIGS. 3 and 4, the wire 52 is tensioned between a fixed support 54 and the intrusion detector 56, the latter being fixed to another support 58. Whenever wire 52 is pulled or cut, this is detected by detector 56, but the detector cannot discriminate between tension changes caused by the temperature or by the wind, from tension changes caused by an attempted entry. The device of FIGS. 3 and 4 is therefore best used for protecting smaller confined areas where the wire span is considerably less than in the case of the embodiment of FIGS. 1 and 2. For example, each detector of FIGS. 1 and 2 may be used with wire spans of 80 meters or more, whereas the detector of FIGS. 3 and 4 may be used with wire span of up to 10 or 20 meters.

The construction of the detector in the latter embodiment is best illustrated in FIG. 4. It includes a housing 60 formed with a large bore 62 open from one end, and with a smaller bore 64 open from the opposite end. The reed switch 66 is diposed within the smaller bore 64, and the conductros 68 from the reed switch pass out through the bore to an electrical signalling, indicating or alarm device.

Within the larger bore 62 is disposed the switch actuator, generally designated 70. This actuator is also of non-magnetic material and carries a permanent magnet 72 in alignment with the reed switch 64. The opposite end 74 of the actuator 70 passes out through bore 62, and is formed with an opening 76 for attachment to the tensioned wire 52.

The wire 52 may be tensioned by a spring 78 attached between the wire and its fixed support 54. Detector 56 includes a counter-spring 80 interposed between an annular shoulder 82 formed on the switch actuator 70, and an apertured closure member 84 through which end 74 of the switch actuator passes.

The detector 56 is attached to its fixed support 58 by means of a clamp 86, and the wire 52 is attached to the detector by passing it through opening 76 of its switch actuator 70.

It will be seen that in the initial position of the switch actuator 70 as illustrated in FIG. 4, permanent magnet 72 is exactly aligned with reed switch 66, so that the reed switch is normally retained in closed condition. If the tension on the wire 52 is changed, by it being pulled or cut, actuator 70 is moved (rightwardly by spring 80 if the wire is cut, and leftwardly if the wire is pulled), so that permanent magnet 72 moves sufficiently out of alignment with reed switch 66 to actuate the latter switch.

The invention has been described with respect to reed switches, since this has been found to provide a substantial degree of reliability. However, it will be appreciated that other electrical switches could also be used. In fact, the device could even be a mechanical signalling device, for example a flag which is actuated when an intrusion is detected. Still further, while the preferred embodiment shows the switch as being fixed and the actuator as being moved by the change in wire tension, it will be appreciated that the opposite could occur, namely the switch could be moved with respect to a fixed actuator.

Also, while the invention has been described with respect to a normally closed reed switch, it will be appreciated that it could also be used with respect to a normally open one.

Further, each span of wire can be made stretchable by its own elasticity (e.g. plastic wire) or by including a spring within it, as described. In the FIGS. 1 and 2 embodiment, which operates by the differential tensioning of the two wire spans, the detector should be mounted substantially midway between the two supports of the tensioned wire to provide the equal stretchability in the two wire spans (i.e. the degree of stretching or elongation per unit force applied) which cancels the tension changes caused by temperature variations and wind forces. The system, however, can tolerate some variation in the mid-point mounting.

Many other changes, variations and applications of the illustrated embodiment will be apparent.

What is claimed is:

1. An intrusion detector comprising a housing attachable to a fixed support; an electrical switch fixed within the housing; said housing being formed with a longitudinal bore extending at least partly therethrough; a switch actuator movable within the longitudinal bore to actuate the switch; said actuator being attachable to a wire tensioned between the movable actuator and another fixed support so as to actuate the switch upon stretching or cutting the wire; a spring disposed within the bore in the housing, one end of the spring engageing said movable actuator to bias same in the direction opposite to said tensioned wire; and an adjustable closure member closing one end of said bore and engaging the opposite end of the spring to preset the initial non-actuating position of the actuator with respect to said switch.

2. An intrusion detector according to claim 1, wherein the switch actuator is attachable to a stretched wire exposed to temperature and wind conditions and is tensioned between two fixed supports, the stretchability of the two spans of wire between said two fixed supports and the actuator being substantially equal to each other so that the switch is actuated only upon the differential tensioning of the two wire spans such as caused by pulling or cutting the wire and is not actuated upon the equal and opposite tensioning of the two wire spans such as caused by temperature changes or the wind, and wherein said housing includes a pair of said springs serving as balancing springs one on each side of the actuator.

3. An intrusion detector according to claim 2, wherein said switch actuator includes an arm extending through a slot in the housing and carries a wire clamp for clamping to the tensioned wire, both ends of said bore being closed by closure members, each of said balanced springs being interposed between one closure member and the respective end of the movable switch actuator, at least one of said closure members being adjustable for presetting the initial, non-actuating position of the actuator with respect to the switch, and the force required to actuate same.

4. An intrusion detector according to claim 2, wherein said two spans of tensioned wire include two balanced springs, each connected in one of said spans.

5. An intrusion detector according to claim 2, wherein said electrical switch is a reed switch, the switch actuator including a permanent magnet for actuating the switch when moved a predetermined distance by the differential tensioning of the wire.

6. An intrusion detector according to claim 5, wherein said reed switch is normally closed and is opened when the actuator is moved a predetermined distance from its initial position by the differential tensioning of the wire.

7. An intrusion detector according to claim 1, wherein said switch is a reed switch and said switch actuator includes a permanent magnet movable within the housing for actuating the reed switch.

8. An intrusion detector according to claim 7, wherein the tensioned wire is a stretchable wire exposed to temperature and wind conditions and tensioned between two fixed supports, said movable switch actuator being attached to the tensioned wire at an intermediate point thereof such that the stretchability of the span of wire between one of the wire supports and the movable switch actuator is substantially equal to that of the span of wire between the other wire support and the movable actuator, whereby the reed switch is actuated only upon the differential tensioning of the two wire spans such as caused by pulling or cutting the wire, and not upon the equal and opposite tensioning of the two wire spans such as caused by temperature changes or the wind.

9. An intrusion detector according to claim 7, wherein said tensioned wire includes only one span, one end of the wire being connected to the fixed wire support and the opposite end of the wire being connected to the movable switch actuator.

* * * * *